United States Patent [19]

Eriksson et al.

[11] Patent Number: 4,719,728

[45] Date of Patent: Jan. 19, 1988

[54] PROFILE SPACING ELEMENT FOR FORMING A WINDOW COMPRISING MORE THAN ONE GLASS IN A WINDOW FRAME

[76] Inventors: Lars Eriksson, Storgatan 40, S-361 00 Emmaboda; Frank Andersson, Korsvägen 8, S-361 04 Eriksmála, both of Sweden

[21] Appl. No.: 852,946

[22] PCT Filed: Aug. 7, 1985

[86] PCT No.: PCT/SE85/00304

§ 371 Date: Apr. 4, 1986

§ 102(e) Date: Apr. 4, 1986

[87] PCT Pub. No.: WO86/01248

PCT Pub. Date: Feb. 27, 1986

[30] Foreign Application Priority Data

Aug. 10, 1984 [SE] Sweden ..... 8404057

[51] Int. Cl.[4] ..... E06B 7/12

[52] U.S. Cl. ..... 52/172; 52/202; 52/631; 52/790; 49/498

[58] Field of Search ..... 52/202, 203, 171, 172, 52/631, 658, 304, 790; 49/498

[56] References Cited

U.S. PATENT DOCUMENTS

| | | | |
|---|---|---|---|
| 3,280,523 | 10/1966 | Stroud et al. | 52/172 |
| 4,109,432 | 8/1978 | Pilz | 52/172 |
| 4,322,926 | 4/1982 | Wölflingseder et al. | 52/631 X |
| 4,453,855 | 6/1984 | Richter et al. | 52/202 X |
| 4,597,232 | 7/1986 | Lingemann | 52/172 X |

FOREIGN PATENT DOCUMENTS

| | | | |
|---|---|---|---|
| 718082 | 1/1932 | France | 52/658 |
| 2457358 | 1/1981 | France | 49/498 |
| WO84/00191 | 1/1984 | PCT Int'l Appl. | 52/203 |

*Primary Examiner*—Carl D. Friedman
*Assistant Examiner*—Richard E. Chilcot, Jr.
*Attorney, Agent, or Firm*—Ostrolenk, Faber, Gerb & Soffen

[57] ABSTRACT

The invention relates to a profile spacing element for mounting of a second glass (2) in a window frame (1) said spacing element serves as a spacer between the glasses. The space between the glasses and the spacing element is sealed. The spacing element (6,15) preferably consists of a non-rigid material which is provided with a diffusion tight covering (9). The covering extends along the entire length of the spacing element and covers its sides (7,8,10) which face towards the glasses (2,5) and the window frame (1). The covering perfects the sealing contact between the spacing element and the glasses and window frame. The diffusion tight material (9) consists of an elastic or resilient material. Further the spacing element preferably is formed as a hollow profile filled with a drying agent and having longitudinally extending deformation notches (11,12) making it possible to bend the spacing element at the corner areas of the window frame without pressing the glasses apart from each other.

5 Claims, 6 Drawing Figures

Figure 1:
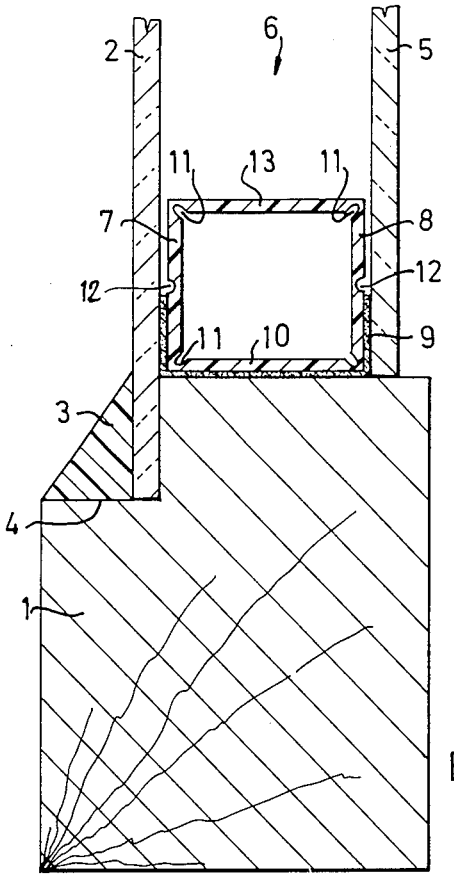

PROFILE SPACING ELEMENT FOR FORMING A WINDOW COMPRISING MORE THAN ONE GLASS IN A WINDOW FRAME

The present invention realtes to a device for applying a second glass at a distance from a first glass in a window frame and including a spacer between the glasses for constituting a closed space between the glasses.

So called insulating glasses are previously known which have a design of the type mentioned above. Such insulating glasses are prefabricated and comprise a frame made very often of aluminium profiles, preferably such having a tubular form, towards the the two flat sides of said frame the glasses are fastened by aid of a suitable adhesive means. The frame is usually formed in such a way that it gets a maximum rigidity in all directions and the adhesive joint between the frame and the two glasses increases this most essential quality. The frame is usually provided with openings or perforations on the side turned towards the space between the glasses and is internally filled with a moisture absorbing substance to prevent forming of condensate on the insides of the glasses. Finally the joint areas between the glasses and the frame are sealed by suitable diffusion preventing material.

An insulating glass of the kind mentioned above cannot be mounted in a frame easily. It has to be connected and aligned into the frame very carefully so that the weight of the glasses will not endanger the insulating glass or the whole window design. This means that a space has to be formed between the end edges of the glasses and the frame on one hand and the part of the window frame facing the edge of the glass package, where suitable bearing connectors, wedges or similar are provided. This space is in itself advantageous as far as the life time of the wood material forming the window frame is concerned. But it means that the frame has a relatively long distance in the direction of the extension of the glass package.

The window frame used in the above mentioned conventional design can usually be dimensioned very thin when it is in fact is the glass package with the integrated frame therein which stands for a determining part of the strength of the whole window. It can be stated that the frame itself only serves to attaching suitable hinges, locks and similar details.

The conventional insulating glass has many advantages for example, the insulating capacity is good, it only has two sides of glasses which have to be cleaned and so on. As disadvantages can be mentioned that it requires for its manufacture an advanced and expensive machine and that it as a rule cannot be applied to older existing, window frames without extensive renewal work.

Different attempts have also been made in trying to fasten an extra, third glass in an already existing window frame.

A type of such subsequently mounted third glass can be regarded as a hanging on window or glass, which is fixed on the frame or the already existing glass by any suitable plastic list, metal profile or similar. The disadvantage with this design besides that condensate is easily formed between the glasses is that it cannot be made hermetically tight. Dirt easily penetrates between the extra glass and the already existing glass, so that in this way a window having three glasses requires at least six different glass surfaces to be cleaned.

Attempts further have been made to provide insulating glass imitating designs in older, already existing window frames. These attempts have however been less successful in that considerable moisture problems have arisen, that the fastening of the extra glass required so large resources what concerns machine-finishing, carefully measuring and so on that the task usually has to be carried out in a factory.

A further problem with such older designs has been that they often have been constructed directly on the design of the conventional insulating glass, on which rigid and not deformable frames have been used, which have totally other moving characteristics during influence of moisture or heat than the case is for the older, conventional and relatively strongly designed window frame of wood. These different moving characteristics often have led to that the extra glass could have been broken, that the sealing has been destroyed with condensate forming between the glasses as a consequence or that other equal simple problems arise during the influence of the moving forces the wood is going through in changing moisture conditions, since these designs are not drained or sealed in a correct manner.

The problems mentioned above is aggravated because several older designs of this type have been formed in such a way that a very prominent moisture moving has occured into the wood to a place near the edge of the glass package, where even so large moisture gatherings could have been existed that a direct frost breaking during winter time has occured.

The present invention is intended to provide a device for mounting of a further glass in a window frame, so that between the extra glass and an already existing glass is formed a hermetically sealed space, which can be compared with the corresponding closed space in an insulating glass window. Another object of the invention is to provide a device which elminates the moisture problem mentioned above, which guarantees an absolute seal during all conditions of the space between the glasses and over and above this in a simple way can be mounted on the place without requiring too exact measure exactness of the adding elements or a perfect right angled condition or similar of the window frame itself.

This purpose is realized by the invention if the device according the invention is characterized in that the space element has a diffusion tight covering which extends continuously from a position with sealing cooperation with the first glass, along the surface of the spacer element turned towards the window frame and to a position with sealing cooperation with the other glass.

Older, existing window frames many times have various defects. Thus the wood parts forming the window frame can be wound or curved, so that the frame therefore diverges from a pane or right-angled form. Even if the wood parts should be straight, they need not form right angles to each other in the corners of the window frame.

In the above mentioned case the fact suitably is that the spacing element is manufactured of a non-rigid material, that the diffusion tight covering consists of a resilent or elastic material and that spacing element having the diffusion tight covering lies against the window frame, at least along the main part of the length of the spacing element.

In one embodiment of the invention the spacing element has the form of a tubular profile body. This can, in the same way as the frame in a conventional insulating glass, internally be filled with a drying agent. This embodiment of the invention is characterized in that the spacing element is provided with deformation notches for providing foldings at the corners of the window frame.

According to the invention the deformation notches also can be provided longitudinally on the sides of the spacing element cooperating with the glasses for bellows formed folding of these sides towards each other when the spacing element is bent in the corner areas of the window frame.

The invention will now be described in detail by aid of the enclosed drawings.

Figure 2:
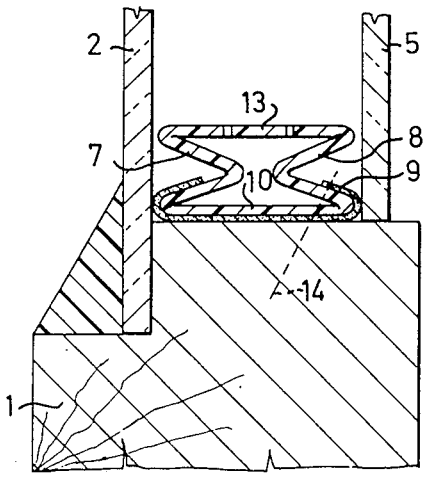
Figure 3:
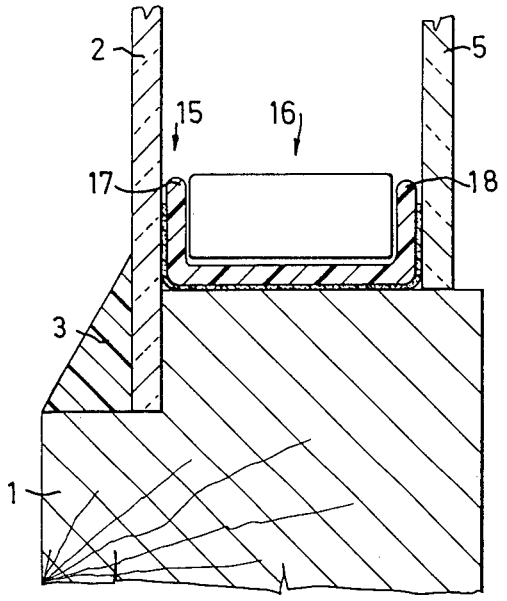
Figure 4:
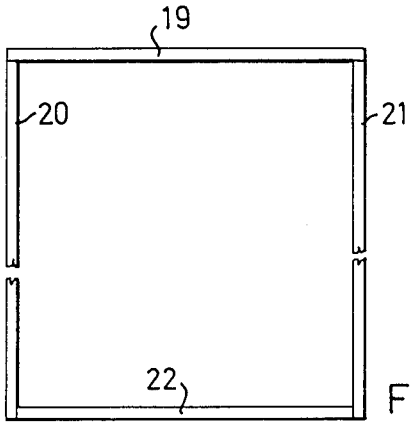
Figure 5:
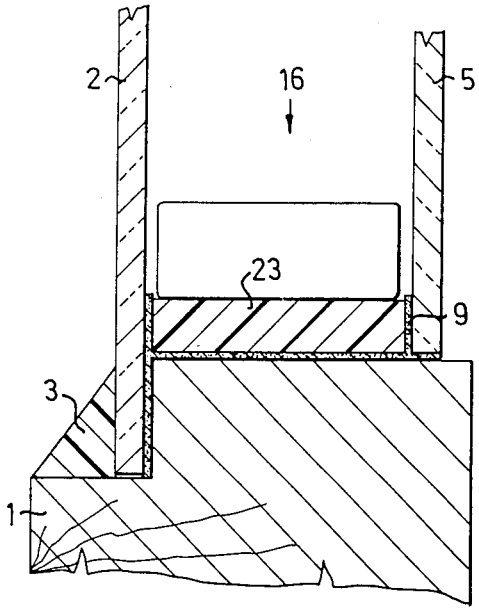
Figure 6:
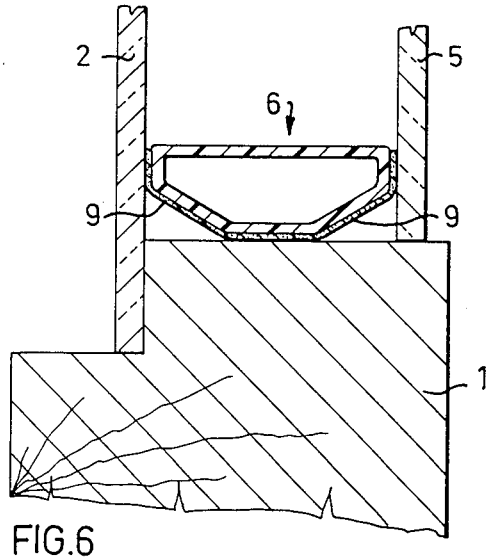

FIG. 1 a section view through an older window frame, provided with an extra glass, FIG. 2 a section view through the frame according to FIG. 1 near to the corner area of the window frame, FIG. 3 a section through a modified embodiment of the invention, FIG. 4 a schematic placement of moisture absorption bars placed in the spacing element used in FIG. 3, FIG. 5 an other modified embodiment of the invention and FIG. 6 a further modified embodiment of the invention.

FIG. 1 illustrates a section of a known, often used window frame, as a rule forming an inner frame in a doubly coupled window. The window frame 1 has an outer glass 2, which is fixed by aid of a putty string 3 in a corresponding groove 4 in the window frame 1. The invention does not depend upon the detail formation of the window frame 1 and for this reason the embodiment illustrated on the drawings shall only be considered as an example. The window frame can of course be of more modern type, where the already existing glass is fastened by a glazing strip of wood or metal. Further the section of the window frame also can be quite different than the one illustrated in the drawings.

According the invention an extra or a second glass 5 has been mounted in the window frame 1 by using of a spacing element 6, which as is illustrated in FIG. 1 and which is formed as a tubular profile having about a rectangular or square section. The spacing element 6 has along at least a part of it towards the two glasses 2 and 5 turned outer sides 7, 8 provided with a diffusion tight covering 9, preferably consisting of a suitable butyl material with a plastic, resilent or similar deformable matter. The diffusion tight covering 9 extends in a continuous layer from the one outer side 7, along the whole side 10 of the spacing element 6 turned towards the window frame 1 and further up upon the other outer side 8. Specially the diffusion tight covering 9 extends around the corner areas between the sides 7 and 10 resp. 9 and 10.

In many cases when older already existing windows are provided with an extra glass, the already existing window frame has so large dimensions that it, in spite of the existing glass helps to brace the design, gets large moving changings. This means that it is both not necessary and not suitable to form the spacing element 6 such as a rigid unity, which the case is in the conventional insulating glass window. Specially inconvenient is this in the corner areas of the window frame. The spacing element 6 according the present invention therefore is made deformable so that it can follow, without producing stresses, the movements of the window frame, especially angle changes at the corners of the window. Further a reason not to make the spacing element 6 such as a rigid frame is that older already existing window frames many times can have been inclined or "settled", so that they are no longer perpendicular in the corners.

According to the invention, the spacing element 6 is suitably formed as a tubular prrofile, which in the embodiment in FIG. 1 along its corners has longitudinally extending deformation notches 11 in the form of one or several grooves, recesses or the like. Corresponding deformation notches 11 in the form of grooves, round, angel-formed or rectangular in section are also provided along the two outer sides 7 and 8 (see FIG. 1).

These notches 11 and 12 preferably can be situated inside along the corners of the spacing element and outside along the middle section of its sides. It shall be pointed out that all notches 11 and 12 may operate well when provided both outside and inside. Also several parallell notches can be used for one and the same folding line.

If a spacing element of a non rigid material, for example plastic, soft metal or similar and provided with the deformation notches mentioned above is bent, so the two outer sides 7 and 8 fold inwardly in bellows like fashion into the spacing element. The underside 10 and the overside 13 of said element are brought closer to touch each other. In this way it is possible to bent the spacing element to fit the angles of the window frame in the corner without increasing the distance between the two glasses 2 and 5 in a more than negligible manner.

In FIG. 2 a section through the design next to a corner is illustrated, where the pressing together of the underside 10 and the upperside 13 of the spacing element 6 to only a limited extent has occurred. The formation of the spacing element 6 in the way stated above has the big advantage that the element in a simple way can be formed after an already existing window frame ignoring how inclined or oblique this happens to be. Further no measure of precision is required which is difficult to reach.

According to the present invention the spacing element 6 can be fastened by nails, clamps or similar, which are pushed in through the element along one direction, which roughly is illustrated with the dotted line 14 in FIG. 2. Such nails, clamps or similar are applied preferable in the corner areas of the window frame.

From FIG. 2 it also can be seen that the diffusion tight covering 9 comes into contact with the two glasses 2 and 5 to the very end of the corner areas of the window frame and around and past these. Further the contacting parts of the two outer sides 7 and 8 in the corner itself will provide a pressing out of the material in the diffusion tight covering 9, so that the sealing effect in this way will be better against the two glasses 2 and 5 in the corner area.

According to the invention the diffusion tight covering 9 extends along the whole limitation area of the spacing element 6 turned against the window frame 1. Thus a perfect sealing is provided of the space between the glasses 2 and 5. Since further the diffusion tight covering is deformable and has good adhesiveness both to the window frame itself and to the spacing element 6, all airing of an eventual space between the material in the window frame and the side 10 of the spacing element 6 turned to window frame will be unnecessary.

The spacing element 6 shown in FIG. 1 and 2 has been described above as a tubular profile. Since it is manufactured of a deformable material and can be folded together according to FIG. 2, so it should also be manufactured as a flat strip, which in connection with the mounting or eventually during an earlier preparation occasioned was folded together to form the closed profile formation. A longitudinally extending joint should for this purpose be made for example in any of the corner areas between the sides 9 and 10 or 7 and 10. The joint should possibly also be situated along the edgeline between the side 13 and some of the sides 7 and 8 and in this case the joint should be made some untight but pressure admitting in the across direction for the side 13, so that the untight joint hereby could replace the perforation (see FIG. 2) or slotting which preferably in an other case ought to be in the side 13 to admit using of the inside placed drying agent in the spacing element.

In FIG. 3 is illustrated a modified embodiment of the invention. In this embodiment a spacing element is used having the form of a U-profile formed rail 15 manufactured by plastic, soft metall or similar. Inside between the legs 17,18 on this rail slotted or perforated bars, tubes or smaller containers are provided, in which drying agent or similar is placed. These bars or tubes 16 can each be situated as can be seen from FIG. 4, i.e. so that an upper part 19 is resting on the upper endsurfaces of two upstanding side parts 20 and 21, between the under end parts of which an under part 22 is provided. Other fastening methods can also be used for example using adhesive, double adhering tape, snapping fasteners or similar.

Similar to what is described above in view of what is shown in FIG. 1 and 2 the U-formed rail 15 is on its outside provided with a diffusion tight covering 9. Similar to what the fact is above this diffusion tight covering 9 extends along the sides of the two legs 17 and 18 turned against the glasses 2 and 5, along the two corner areas and continuously along the whole side turned towards the window frame 1. The diffusion tight covering can be applied in one or several longitudinally extending strings or layers, which are permitted to flow together or have been joined along their longitudinally extending edges.

The corner areas in the window frame are provided in this embodiment simply by that V-formed recesses are cut in the two legs 17 and 18, whereupon the U-formed rail 15 is bent to right angle and the bars or tubes 16 having moisture absorbing material are placed inside the U-formed rail. Of course the rail can also be cut into four separate parts, which are mounted each per se for example as shown in FIG. 4 and which are sealed in the joining areas by projecting parts or extra fastened strips of diffusion tight material.

As an alternative to the U-formed rail shown in FIG. 3. an I-formed profile 23 can also be used or a flat profile (see FIG. 5), which along its sides turned towards the glasses 2 and 5 and the window frame is provided with layers of diffusion tight material 9. Also in this embodiment the drying agent can be placed in separate containers, in rectangular or in other way formed bars or tubes 16, which are applied against the longitudinally extending side of the profile turned from the window frame.

When mounting this embodiment one can use both bending in the corners, cutting and joining. Further the bars, tubes or containers having drying agent can of course be fastened in a way mentioned above.

In FIG. 6 is illustrated a further usable embodiment of the spacing element 6. Also in this embodiment a diffusion tight covering 9 is used, which extends from the two cooperating areas of the spacing element 6 with the two glasses 2 and 5 and continuously along the whole side of the spacing element turned towards the window frame.

Further section formations of the spacing element 6 are possible according the present invention and thus said element can for example be formed such as a more or less circular hose or an elliptic or oval hose. Further the spacing element already at the manufacturing can be provided with the form shown in FIG. 2.

As mentioned above the spacing element according the present invention preferably can be manufactured in running lengths and that the diffusion tight covering is applied on the spacing element already during the manufacturing. The great advantage is achieved by this in that the formation of the spacing element simply can be adapted to both inclineness, obliqueness or similar of an already existing window frame. Further the need of more or less sophisticated corner mountings is eliminated, since the spacing element according to the present invention either can be joined end to end directly in a corner of the window frame or also end to end in some other position of the window frame. The seal in the joining area is provided simply by adapting another layer of diffusion tightening material over the joint or also in that the diffusion tight material is provided with a part extending outside the end of the profile and which can overlap the joint and be folded up over the sides of the profile. The one or the projecting parts of the diffusion tight material can also be folded inwardly, so that they will be placed against each other and between towards each other turned ends of the profiles.

As an alternative the spacing element can also according to the invention be cut and mounted by four different parts, for example with the pattern illustrated in FIG. 4.

The diffusion tight material 9 can according to the invention be placed upon or sprayed onto the element or profile 6 and 16 in the form of a strip folded up on the sides of the element. Alternatively several for example three strings or strips of such a material can however be adapted on the element, so that the joining areas between these strips are brought to contact each other for example along the corner edges of the element.

We claim:

1. A spacing element for spacing first and second window panes and for defining a closed sealed space between the panes, the closed space having at least one corner region, said spacing element comprising:

an elongate, hollow body having at least one corner section for traversing the at least one corner region of the closed space, the hollow body having a first side wall adjacent said first window pane, a second side wall adjacent said second window pane and a bottom wall adjacent a window frame for said first and second window panes, the hollow body further including first and second longitudinally extending deformation notches extending, respectively, along said first and second side walls, said side walls being deformed away from the window panes at said corner section, said hollow body and said longituinal deformations being effective to enable said body to bend sharply at said at least one corner section without causing said body to bulge transversely to its longitudinal direction at its said corner section; and a resilient and continuous covering formed of elastic material, said covering extending longitudinally along said hollow body to form a diffusion tight seal between said hollow body, on the one hand, and said first and second window panes and said window frame, on the other hand, said covering extending along said first and second walls and along said bottom wall.

2. The spacing element of claim 1, wherein said longitudinally extending deformation notches formed on said first and second side walls face said window panes.

3. The spacing element of claim 1, wherein said longitudinally extending formation notches face inside said hollow body.

4. The spacing element of claim 2, wherein said tubular body is generally rectangularly shaped in transverse cross-section at locations thereof away from said at least one corner region.

5. The spacing element of claim 4, wherein said rectangularly shaped hollow body comprises four longitudinally extending corner regions and further comprising a respective notch extending longitudinally along each of said corner regions of said body.

* * * * *